US007743752B2

(12) United States Patent
Kerns et al.

(10) Patent No.: US 7,743,752 B2
(45) Date of Patent: Jun. 29, 2010

(54) SYSTEM AND METHOD FOR IMPROVING FUEL VAPOR PURGING FOR AN ENGINE HAVING A COMPRESSOR

(75) Inventors: James Michael Kerns, Trenton, MI (US); Ralph Wayne Cunningham, Milan, MI (US); Thomas G. Leone, Ypsilanti, MI (US); Gopichandra Surnilla, West Bloomfield, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 10 days.

(21) Appl. No.: 12/176,201

(22) Filed: Jul. 18, 2008

(65) Prior Publication Data

US 2010/0012099 A1 Jan. 21, 2010

(51) Int. Cl.
*F02M 33/04* (2006.01)
*F02M 33/02* (2006.01)

(52) U.S. Cl. ..... 123/520

(58) Field of Classification Search ..... 123/520, 123/519, 518, 516, 198 D, 382, 383
See application file for complete search history.

(56) References Cited

U.S. PATENT DOCUMENTS 4,530,210 A 7/1985 Yamazaki
5,005,550 A 4/1991 Bugin, Jr. et al.
5,080,078 A * 1/1992 Hamburg ..... 123/521
5,183,023 A * 2/1993 Hanson ..... 123/520
5,331,940 A 7/1994 Takayama
5,979,418 A * 11/1999 Saruwatari et al. ..... 123/519
5,992,397 A 11/1999 Hideaki et al.
6,000,367 A 12/1999 Huff et al.
6,138,644 A 10/2000 Saruwatari et al.
6,446,618 B1 9/2002 Hill
6,606,982 B1 8/2003 Stockhausen et al.
6,659,093 B2 12/2003 Kim
6,679,228 B1 1/2004 Confer et al.
6,729,316 B1 5/2004 Knowles
6,739,320 B2 5/2004 Ito et al.
6,910,467 B2 * 6/2005 Murakami et al. ..... 123/520
6,966,304 B2 11/2005 Nagaishi et al.
6,970,957 B1 11/2005 Oshins et al.
6,997,172 B2 2/2006 Oshimi et al.
7,293,552 B2 11/2007 Leone et al.
7,316,223 B2 1/2008 Wakahara
2004/0244368 A1 12/2004 Yang et al.
2007/0113831 A1 5/2007 Hoke et al.
2007/0227515 A1 10/2007 Uchida

* cited by examiner

*Primary Examiner*—Mahmoud Gimie
(74) *Attorney, Agent, or Firm*—Allan J. Lippa; Alleman Hall McCoy Russell & Tuttle LLP

(57) ABSTRACT

A system and method for storing and purging fuel vapors for an internal combustion engine comprising a compressor is presented. The system allows the canister to be purged even while the engine is operated at high engine load.

21 Claims, 4 Drawing Sheets

SYSTEM AND METHOD FOR IMPROVING FUEL VAPOR PURGING FOR AN ENGINE HAVING A COMPRESSOR

FIELD

The present description relates to improving purging of fuel vapor from a canister for an internal combustion engine having an inlet air compressor.

BACKGROUND

A system for storing and purging fuel vapors from a canister is described in U.S. Patent Application 2007/0227515. The patent application describes a method for using the output of a compressor to provide a positive pressure to a fuel vapor storage canister. The positive pressure is used to move fuel vapors to the compressor's inlet and the canister is purged of fuel vapor.

The above-mentioned system can also have disadvantages. For example, the system uses output from the compressor to purge fuel vapors from a canister, and the canister vapors are directed to the compressor inlet. Thus, air entering the canister during canister purge already contains fuel, thereby lowering purging efficiency.

The inventors herein have recognized the above-mentioned disadvantages and have developed a system and method that offers substantial improvements.

SUMMARY

One embodiment of the present description includes a system for purging a vehicle's fuel vapor storage canister, the system comprising: an internal combustion engine; a throttle for regulating air flow to the internal combustion engine; a compressor located upstream from the throttle in the engine's intake system; and a fuel vapor canister that is in communication with an engine's intake system at a first location that is downstream from the compressor, and the fuel vapor canister also in communication with the engine's intake system at a second location that is downstream from the throttle. This system overcomes at least some disadvantages of the above-mentioned system.

A fuel vapor storage canister can be efficiently purged by an engine having an inlet air compressor when the compressor is used to pressurize the fuel vapor storage canister with fresh air. The compressor heats the fresh air as the air passes through the compressor. Heating the air improves the rate of fuel desorption from the canister to the air as the air passes through the canister. The pressurized canister can be vented to the engine's intake manifold where the fuel vapors may be inducted into engine cylinders and combusted even if pressure in the intake manifold is above atmospheric pressure.

The present description can provide several advantages. Namely, the present system can increase fuel vapor canister purging efficiency. In addition, the system can purge during high engine load conditions. Furthermore, the present system can reduce fuel deposits that may form in the intake system if fuel vapors are introduced to the engine at a location that is upstream from the intake manifold.

The above advantages and other advantages, and features of the present description will be readily apparent from the following Detailed Description when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
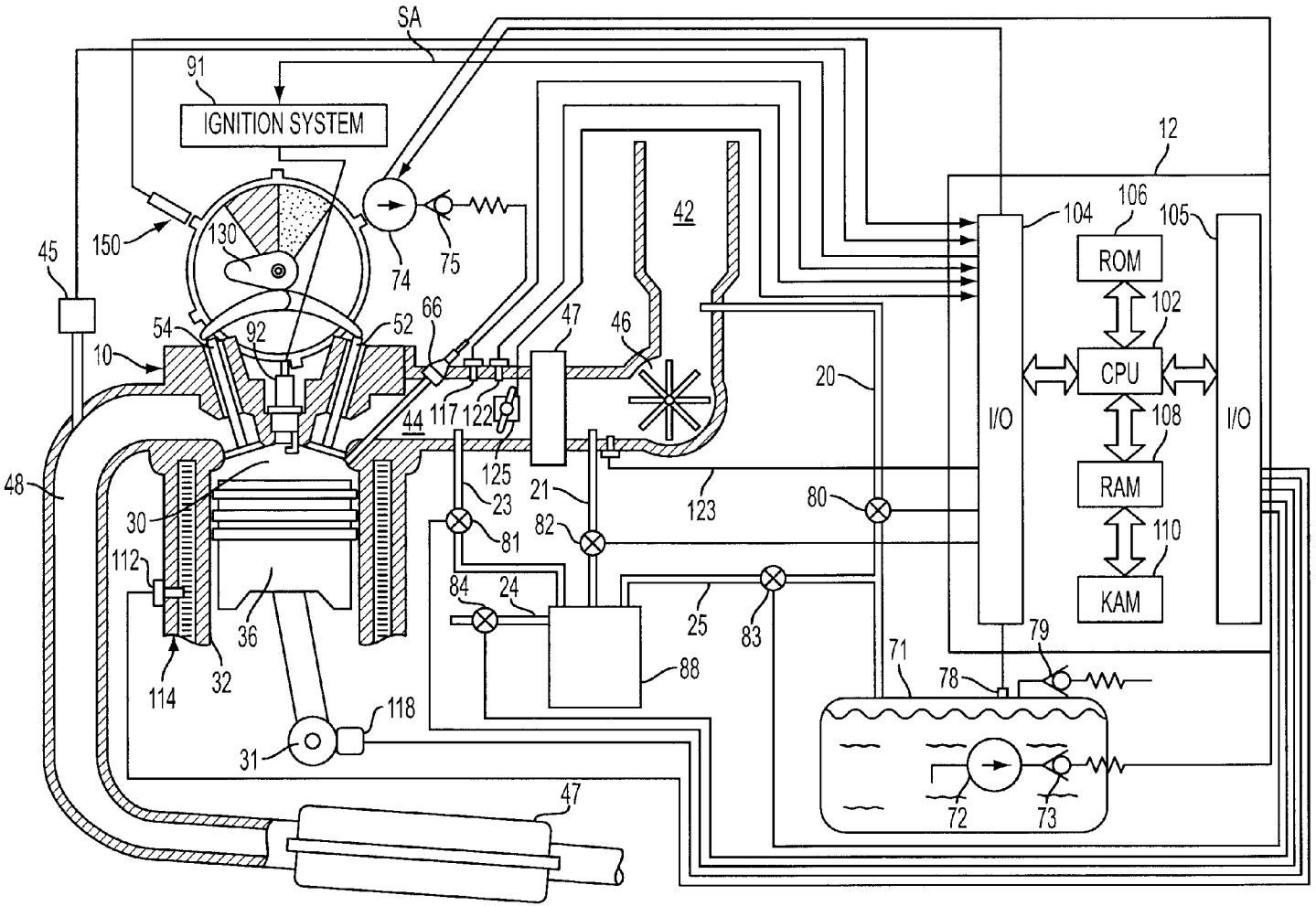
FIG. 1 is a schematic diagram of an example engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 31. Combustion chamber 30 is shown communicating with intake manifold 44 and exhaust manifold 48 via respective intake valve 52 and exhaust valve 54. Each intake and exhaust valve is operated by a mechanically driven cam 130, which may include a mechanism to achieve variable valve timing and/or variable valve lift. Alternatively, intake valves and/or exhaust valves may be operated by electrically or hydraulically actuated valves.

Air is supplied to combustion chamber 30 from inlet duct 42. Air enters duct 42 and is compressed by compressor 46. Compressor 46 may be a turbocharger or a supercharger. Compressed air exits compressor 46 and is cooled as it passes through intercooler 47. Air flow into intake manifold 44 is regulated by throttle 125.

Fuel is injected directly into cylinder 30 by way of fuel injector 66. The amount of fuel delivered is proportional to the pulse width of a signal sent from controller 12. Fuel is delivered to fuel injector 66 by injection pump 74. The injection pump may be mechanically driven by the engine or electrically driven. Check valve 75 allows fuel flow from injection pump 74 to fuel injector 66 and limits flow from fuel injector 66 to injection pump 74. Lift pump 72 provides fuel from fuel tank 71 to fuel injection pump 74. Lift pump 72 may be electrically or mechanically driven. Check valve 73 allows fuel to flow from fuel pump 72 and limits fuel flow backwards into fuel pump 72. Check valve 79 controls flow between fuel tank 71 and atmosphere.

Note that the lift pump and/or injection pumps described above may be electrically, hydraulically, or mechanically driven without departing from the scope or breadth of the present description.

Distributor-less ignition system 91 provides ignition spark to combustion chamber 30 via spark plug 92 in response to controller 12. Universal Exhaust Gas Oxygen (UEGO) sensor 45 is shown coupled to exhaust manifold 48 upstream of catalytic converter 47. Converter 47 can include multiple catalyst bricks, in one example. In another example, multiple emission control devices, each with multiple bricks, can be used. Converter 47 can be a three-way type catalyst in one example.

Fuel vapor canister 88 is used to store fuel vapors that originate in fuel tank 71. Optional duct 20 connects fuel tank 71 to the intake system on the inlet side of compressor 46 by way of control valve 80. Duct 25 connects fuel tank 71 to fuel vapor canister 88 by way of control valve 83. Duct 21 connects fuel vapor canister 88 to the intake system on the outlet side of compressor 46 by way of control valve 82. Duct 23 connects fuel vapor canister 88 to the intake system on the downstream side of throttle body 125 by way of control valve 81. Duct 24 connects fuel vapor canister 88 to atmosphere by way of valve 84.

Controller 12 is shown in FIG. 1 as a conventional microcomputer including: microprocessor unit 102, input/output ports 104-105, and read-only-memory 106, random-access-memory 108, keep-alive-memory 110, and a conventional data bus. Controller 12 is shown receiving various signals from sensors coupled to engine 10, in addition to those signals previously discussed, including: engine coolant temperature (ECT) from temperature sensor 112 coupled to water jacket 114; a measurement of engine manifold pressure (MAP) from pressure sensor 122 coupled to intake manifold 44; compressor outlet pressure from pressure sensor 123; a fuel tank pressure sensor 78; cam position sensor 150; a throttle position sensor (not shown); a measurement (ACT) of engine air amount temperature or manifold temperature from temperature sensor 117; and an engine position signal from a Hall effect sensor 118 sensing crankshaft 31 position. In one aspect of the present description, engine position sensor 118 produces a predetermined number of equally spaced pulses every revolution of the crankshaft from which engine speed (RPM) can be determined.

Storage medium read-only memory 106 can be programmed with computer readable data representing instructions executable by processor 102 for performing the methods described below as well as other variants that are anticipated but not specifically listed.

Figure 2:
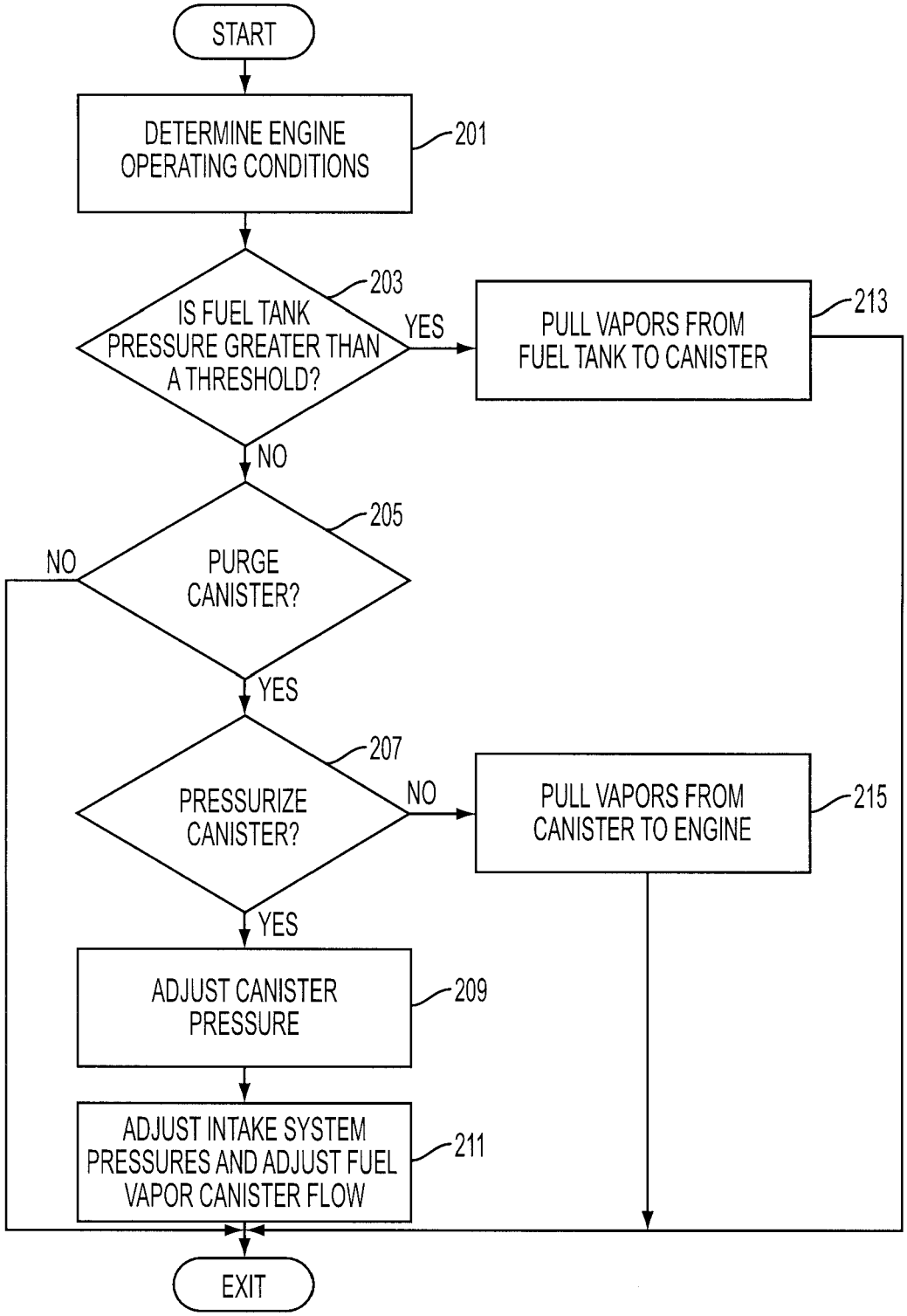
FIG. 2 is a flowchart of an example method for improving fuel vapor purging.

Referring now to FIG. 2, a flow chart of an example method for controlling fuel vapor canister purging is shown. The method of FIG. 2 may be used with the system configurations illustrated in FIGS. 3-4 or other system configurations without departing from the scope or intent of the present method.

At step 201, engine operating conditions are determined. Engine coolant temperature, time since start, ambient temperature, engine load, fuel injection amount, fuel tank pressure, and exhaust gas oxygen concentration are inferred or sensed. However, additional or fewer engine operating parameters may be input from sensor data if desired. In addition, some engine operating conditions are determined from characterized data and from other sensed engine operating conditions. For example, engine exhaust gas temperature may be inferred from engine speed, cylinder air charge, and engine coolant temperature. After determining engine operating conditions, the routine proceeds to step 203.

At step 203, the routine determines if pressure in the fuel tank exceeds a threshold. If so, the routine proceeds to step 213. Otherwise, the routine proceeds to step 205.

At step 205, the routine decides whether or not to purge the fuel vapor storage canister. The canister may be purged at a variety of conditions. For example, the canister may be purged when the engine is restarted after the engine has been stopped for a period of time. Alternatively, the canister may be purged periodically during engine operation to reduce fuel vapors that may form within the fuel tank. In one embodiment, fuel vapor canister purge is initiated as a function of the time since the last fuel vapor canister purge cycle and ambient air temperature. In particular, a timer may be used to keep track of the amount of time lapsed since the canister was last purged. The accumulated time stored in the timer is compared to the output from a table or function that relates the fuel vapor canister purge interval to ambient air temperature. If the accumulated time reaches or exceeds the amount of time stored in the table or function, then purge of the fuel vapor canister is initiated. In one embodiment, the amount of time between fuel vapor canister purging sequences decreases as ambient air temperature increases. In another embodiment, canister purge is initiated in response to the pressure relieved from the fuel tank and the number of times pressure is relieved from the fuel tank. If the routine determines that conditions are present for purging the fuel canister, then the routine proceeds to step 207. If conditions are not present to purge the fuel vapor canister, the routine proceeds to exit.

At step 207, the routine determines whether or not to pressurize the fuel vapor canister to prepare for purging the canister of fuel vapors. In one embodiment, if it is desirable to purge the fuel vapor canister and the desired engine torque is above a threshold amount, the canister control valves are set to pressurize the canister and begin a purge cycle. If it is desirable to purge the fuel vapor canister and the desired engine torque is below the threshold amount, then the canister control valves are set to allow intake manifold vacuum to draw fuel vapors from the fuel vapor canister. In alternate embodiments, the decision to pressurize the canister may be based on intake manifold pressure and/or other parameters. For example, if the intake manifold pressure is greater than a threshold, the canister may be pressurized to facilitate purging the canister. If the routine determines to pressurize the canister, the routine proceeds to step 209. Otherwise, the routine proceeds to step 215.

At step 209, fuel vapor canister pressure is adjusted so that the desired purge flow rate into the intake manifold can be achieved. Canister pressure may be raised and lowered while engine torque follows a desired engine torque by adjusting the compressor efficiency and throttle position. The desired canister pressure may be empirically determined and stored tables and/or functions in memory. The tables and/or functions may be indexed by desired torque and engine speed.

In one embodiment, the waste gate position of a turbocharger may be adjusted along with the throttle position. Further, in the example of a variable geometry turbocharger, the turbine vanes may be adjusted with the throttle position. In one example, a pressure sensor located in the intake system at a location that is downstream from the compressor and upstream from the throttle may be used to control compressor efficiency, see FIG. 1 pressure sensor 123 for example. The compressor efficiency and throttle position are adjusted to achieve a desired pressure in the intake system downstream from the compressor and the desired intake manifold pressure. The desired intake system pressure may be substantially constant or it may vary with engine operating conditions. If the compressor outlet pressure is above a threshold, the compressor efficiency can be reduced to lower the compressor outlet pressure. If the compressor outlet pressure is less than a threshold, the compressor efficiency can be increased to raise the compressor outlet pressure. The throttle position is adjusted to provide the desired engine flow rate and torque as described in step 211.

The fuel vapor canister pressure can be set to the pressure developed at the compressor output by opening the canister pressure control valve, see FIG. 1, valve 82 for example. Alternatively, the canister pressure can be set to the pressure developed at the compressor output or lower by controlling the position of the canister pressure control valve. Of course, the specific manner by which fuel vapor canister pressure is controlled may vary with valve configuration and compressor selection and as such the present description is not limited to a single particular valve or compressor configuration.

After adjusting the canister pressure the routine proceeds to step 211.

At step 211, pressures in the intake system are controlled by adjusting actuators along the length of the intake system. For example, intake manifold pressure is controlled by adjusting valve timing, throttle position, and vapor management valve position. Engine speed and desired torque can be used to index tables and functions that contain empirically determined actuator positions for the cams, throttle, and vapor management valve. These open loop actuator positions allow the engine to operate near the desired engine operating conditions. The throttle and fuel vapor control valves can be adjusted so that the flow from the canister and the throttle body contribute partial pressures in the intake manifold that allow the engine to produce the desired engine torque while achieving the desired fuel canister purge rate. In one embodiment, the vapor management valve is set to a position that produces the desired canister flow rate at the pressure ratio that exists across the vapor management valve (e.g., see FIG. 1, valve 81). The vapor management valve position is determined from flow characteristics that are stored in tables and/or functions in memory. The tables and functions are indexed using the pressure ratio that exists between the intake manifold and the fuel vapor storage canister and the table outputs a valve duty cycle. The routine commands the valve duty cycle that establishes the desired fuel vapor canister purge flow rate. The desired fuel vapor canister purge flow rate is empirically determined data that may be retrieved from memory in response to engine speed and requested engine torque, for example.

The desired throttle position can be related to the amount of engine torque commanded by the powertrain controller and may be described in terms of engine brake torque by the following equation:

$$Ind_Tor = Dsd_Brk_Tor + Fric_Tor + \mathrm{Loss}_Tor$$

where Ind_Tor represents the desired indicated engine torque, Dsd_Brk_Tor represents the desired engine brake torque, Fric_Tor represents the engine friction torque, and Loss_Tor represents the engine torque losses (e.g., accessories such as electrical loads and/or power steering pumps). The engine friction torque and losses may be determined by interrogating empirically based tables and/or functions that describe operation of the engine over various operating conditions.

Cylinder load (i.e., the fraction of theoretical cylinder air capacity at standard temperature and pressure, e.g., 0.5 load corresponds to half the theoretical cylinder air capacity of a cylinder) for an engine having cylinders that are inducting substantially equal (e.g., within ±10% of each other) air-fuel mixtures into all cylinders may be determined by the following equation:

$$\mathrm{Load} = FNLOAD\left(N, \left(\mathrm{ind_Tor} \times \frac{1}{FNSPKRTO(SAF)}\right)\right)$$

where FNLOAD is a predetermined table that outputs a fractional cylinder load (e.g., 0.5), and that may be indexed by engine speed and corrected indicated torque; N is engine speed; and FNSPKRTO is a function that adjusts engine torque as spark is adjusted from minimum spark for best torque.

Cylinder air charge may be determined by multiplying the desired engine load by the theoretical cylinder air charge capacity at standard temperature and pressure. The desired air flow through the engine may be determined by the following equation:

$$\mathrm{Des_am} = \left(sarchg \times N \times \frac{numcyl}{2} \times \mathrm{Load}\right) - \mathrm{Can_flow}$$

where Load is cylinder load determined by the above-mentioned method, numcyl is the number of engine cylinders, N is engine speed, sarchg is the theoretical cylinder air charge at standard temperature and pressure, and Can_flow is the flow from the fuel vapor canister to the intake manifold.

The desired air flow through the engine and the pressure drop across the throttle are used to determine engine throttle position. The compressor outlet pressure and intake manifold pressures may be used to (e.g., see FIG. 1 elements 122 and 123) to determine the pressure drop across the engine throttle. The throttle angle can be determined via the following expression:

$$Tangle = F\mathrm{Throttle}(Des_\mathrm{am}, TP\mathrm{drop})$$

where Tangle is the throttle angle or position, FThrottle is a function or map that outputs the throttle angle to achieve the desired flow rate at a particular pressure drop across the throttle, and TPdrop is the pressure drop across the throttle body.

Pressure at the compressor outlet can be controlled by adjusting the efficiency of compressor 46 by way of the surge control valve (not shown). Alternatively, if the compressor is driven by an exhaust turbine, the compressor efficiency can be adjusted by adjusting the position of a waste gate or by adjusting the position of vanes in the exhaust system. For the configuration illustrated in FIG. 1, pressure in the fuel vapor canister can be adjusted by controlling the positions of valves 81, 82, 83, and 84. Pressure purge control valve 82 can be used to control canister pressure when it is desirable to have canister pressure higher than atmospheric pressure. Canister vent valve 84, which may be a pressure relief valve, can be used to relieve canister pressure if pressure in the canister exceeds a threshold. Alternatively, canister vent valve 84 may be used to draw fresh air into the canister when the canister contents are drawn to the intake manifold.

The amount of time that the fuel vapor canister is purged while under positive pressure can be determined by the amount of fuel estimated to be stored in the fuel vapor canister or by the amount of oxygen sensed in the engine's exhaust gases. In one embodiment, the amount of fuel estimated to be stored in the fuel vapor canister is determined by the number of times that vapor is released from the fuel tank to the fuel vapor storage canister and the fuel tank pressure before the fuel vapors were released to the fuel vapor canister. Alternatively, the amount of fuel vapor stored in the fuel vapor canister can be estimated from the exhaust gas oxygen sensor indicating a fuel mixture that is richer or leaner than expected.

It should be noted that during fuel vapor canister purging, fuel delivered from fuel injectors is proportionally reduced in relation to the amount of fuel vapors that are estimated entering the engine from the fuel vapor canister. Oxygen sensor feedback can be used to adjust fuel injector pulsewidth so that the engine air-fuel ratio is enriched or leaned to match a desired engine air-fuel ratio when the fuel vapor canister is purged. For example, if the oxygen sensor senses an exhaust gas concentration that is leaner (i.e., excess O2) than the desired oxygen concentration, then the fuel injector pulsewidth can be adjusted in proportion to the difference between the actual and desired exhaust gas oxygen concentration.

At step 213, the routine controls the vapor management valves so that fuel vapors can be drawn from the fuel tank to the fuel vapor canister. In one embodiment of the valve configuration illustrated in FIG. 1, valves 83 and 81 are commanded open and valves 84, 82 and 80 are commanded closed. Opening valves 81 and 83 allows manifold vacuum to draw fuel tank vapors from fuel tank 71 into intake manifold 44. After the fuel tank pressure is reduced to the predetermined level, the vapor control valves are controlled to trap fuel vapors in the fuel tank. For example, valves 80 and 83 are commanded closed. The routine proceeds to exit after the vapor management valves are positioned.

In an alternate embodiment, valves 83 and 84 are commanded open and valves 81, 82, and 80 are commanded closed. Opening valves 83 and 84 allows fuel tank pressure to push fuel tank vapors from fuel tank 71 to fuel vapor canister 88. After the fuel tank pressure is reduced to a predetermined level, the vapor control valves are controlled to trap fuel vapors. For example, valves 83 and 84 are commanded closed.

At step 215, the routine controls the vapor control valves so that fuel vapors are pulled from the canister to the engine. In one embodiment, the valves are set to draw vapors from the fuel vapor canister until an oxygen sensor in the engine's exhaust indicates a lack of fuel vapor being inducted to the engine from the canister. For example, for the system configuration illustrated in FIG. 1, valves 81 and 84 can be commanded open so that the fuel vapor canister contents are drawn into the intake manifold by intake manifold vacuum. Fuel vapors in the fuel vapor canister are replaced by fresh air drawn in through valve 84. After substantially all fuel vapors are pulled from the fuel vapor canister or when conditions are no longer suitable for pulling vapors, the vapor control valves are closed to trap any remaining fuel vapors in the fuel vapor storage canister. For example, valves 81 and 84 are closed. The routine proceeds to exit after the vapor management valves are positioned.

Figure 3:
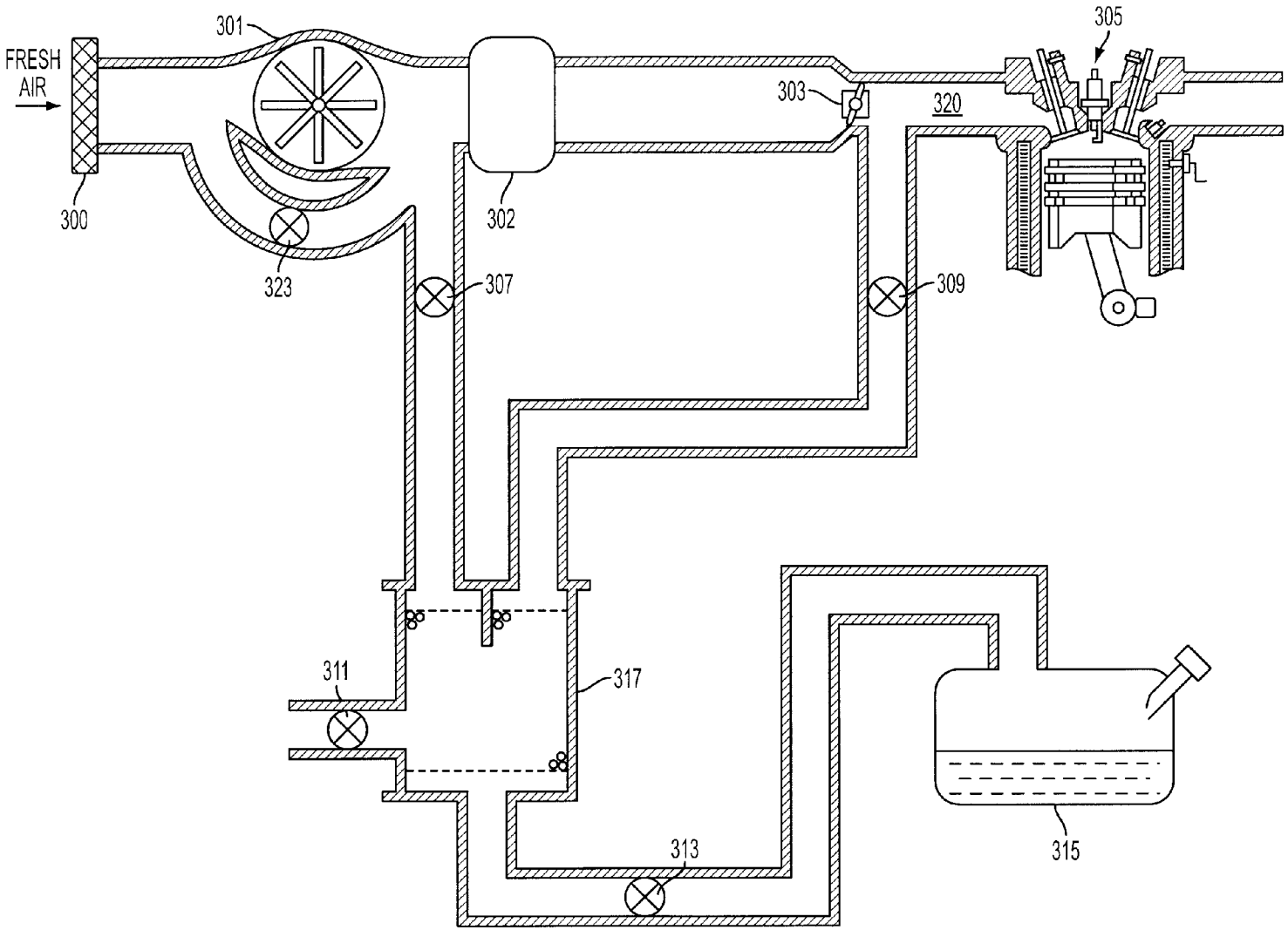
FIG. 3 is a schematic diagram of an example fuel vapor canister purging system.

Referring now to FIG. 3, a schematic diagram of an example fuel vapor canister purging system is shown. Fresh air enters the intake system at air cleaner 300 and passes through compressor 301. Pressurized fresh air may be directed through intercooler 302, pressure purge control valve 307, and/or surge control valve 323. Surge control valve 323 can be used to control compressor outlet pressure. If the compressor outlet pressure exceeds a threshold, surge valve 323 can be opened so that a portion of the compressor output is fed back to the compressor input, thereby reducing the compressor efficiency. Pressure purge control valve 307 can be used to control the flow of compressed air to fuel vapor canister 317. Throttle 303 is used to regulate the flow of fresh air into intake manifold 320 and pressure in the intake system downstream from the throttle. Air exits the intake system and enters the engine after passing through intake manifold 320. Fuel vapor management valve 309 can be used to control the flow of fuel vapor from fuel vapor canister 317 into intake manifold 320. Optional canister vent valve 311 can be used to vent canister 317 if pressure in the canister rises above a threshold amount. Fuel tank vapor valve 313 is used to control the flow of fuel vapor from fuel tank 315 to fuel vapor canister 317.

Figure 4:
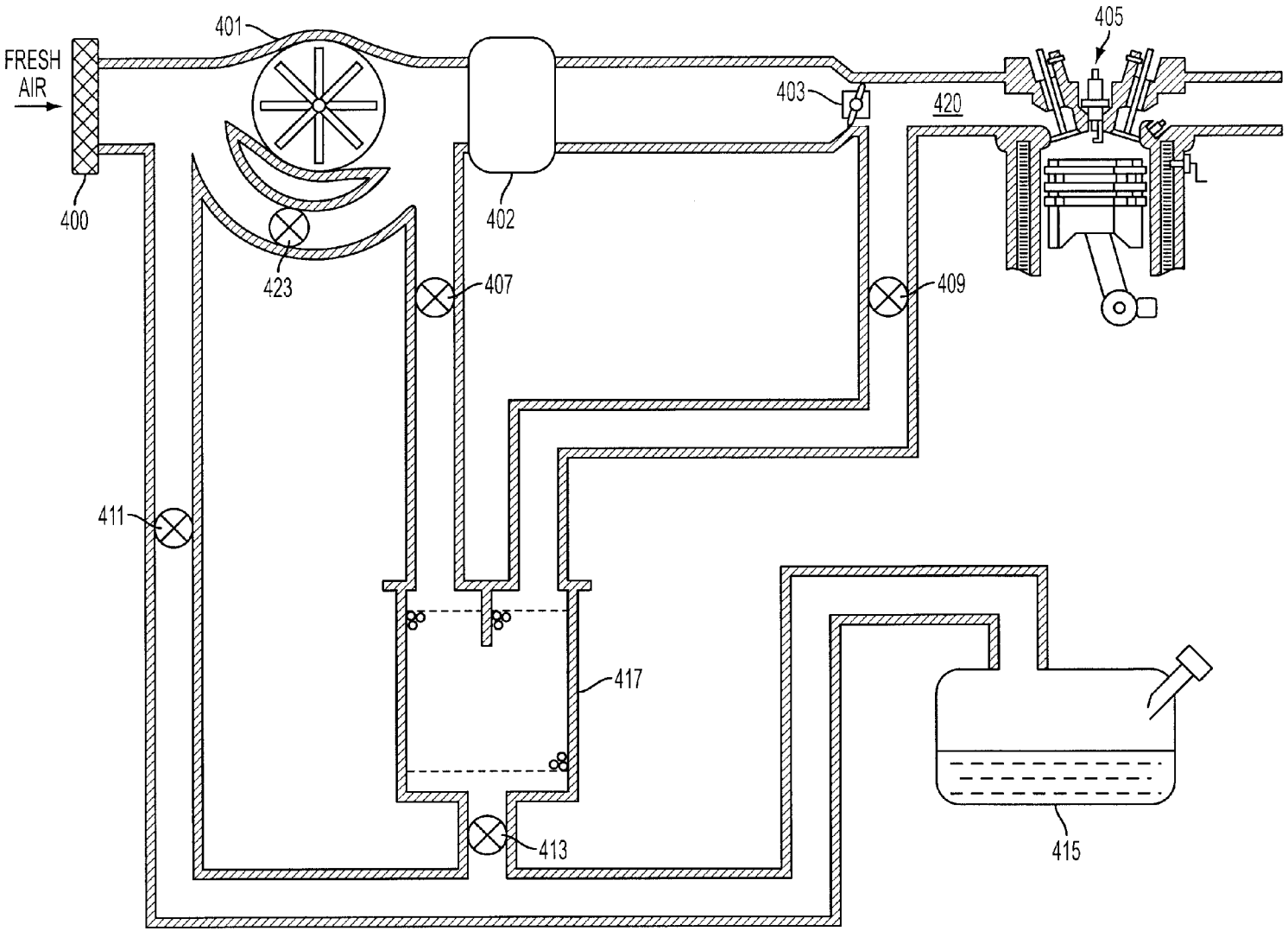
FIG. 4 is an alternative schematic diagram of an example fuel vapor canister purging system.

Note that a pressure sensor may be used to determine the pressure in canister 317 of FIG. 3, pressure of canister 417 shown if FIG. 4 may be determined likewise.

In one embodiment, fuel vapor canister 317 can be purged when intake manifold pressure is below barometric pressure by closing pressure purge control valve 307, opening canister vent valve 311, closing fuel tank vapor valve 313, and metering fuel vapor management valve 309.

When intake manifold pressure is above barometric pressure, the fuel vapor canister can be purged by closing canister vent valve 311, closing fuel tank vapor valve 313, opening pressure purge control valve 307, and metering fuel vapor management valve 309.

The actual flow rate of vapor from fuel vapor canister 317 is determined by the pressure differential between fuel vapor canister pressure and intake manifold pressure as well as the position of fuel vapor management valve 309. The desired flow rate from the fuel vapor canister to the engine can be determined from tables that contain empirically determined flow rates that are indexed by the engine torque request and engine speed. The actual fuel canister flow rate is controlled to the desired fuel canister flow rate by adjusting the canister pressure. Vapor management valve 309 is moved to a position stored in memory that corresponds to the desired flow rate at the pressure ratio that is across the vapor management valve.

If the engine torque request is low and the fuel vapor quantity stored in the fuel vapor canister is high, the flow rate from the fuel vapor canister to the engine will be low. If the engine torque request is low and the fuel vapor and the fuel vapor quantity stored in the fuel vapor canister is low, the flow rate from the fuel vapor canister to the engine will be medium to high. If the engine torque request is high and fuel vapors stored in the fuel vapor canister are between low and high, the flow rate from the fuel vapor canister to the engine intake manifold may be controlled to a high flow rate. If little fuel vapor is stored in the fuel vapor canister, the flow rate from the fuel vapor canister to the engine intake manifold may be substantially zero. Thus, the flow rate of fuel vapors being transferred from the fuel vapor canister to the engine intake manifold can vary relative to the amount of fuel vapor stored in the canister and the engine torque demand. The amount of fuel vapor stored in the fuel vapor canister can be estimated by estimating the amount of fuel vapor moved from the fuel tank to the fuel vapor canister. The amount of fuel transferred from the fuel tank to the canister may be estimated from the fuel tank pressure and ambient air temperature.

As described in step 211 of FIG. 2, pressures in the intake system can be controlled by adjusting actuators along the length of the intake system. For example with regard to FIG. 3, intake manifold pressure is controlled by adjusting valve timing, throttle position, surge valve, and vapor management valve position. Engine speed and desired torque are used to index tables and functions that contain empirically determined actuator positions at which the desired engine torque is produced. Intake manifold pressure can be controlled in a closed-loop manner by determining intake manifold pressure from a pressure sensor (not shown in FIG. 3) and then adjusting the position of throttle 303 and vapor management valve 309. Pressure at the compressor outlet can be controlled by adjusting the efficiency of compressor 301 by way of surge control valve 323. Alternatively, if the compressor is driven by an exhaust turbine, the compressor efficiency can be adjusted by adjusting the position of a waste gate or by adjusting the position of vanes in the exhaust system. Pressure in the fuel vapor canister can be adjusted by controlling the positions of valves 307, 309, 311, and 313. Pressure purge control valve 307 can be used to control canister pressure when it is desirable to have canister pressure higher than atmospheric pressure. Canister vent valve 311 can be used to relieve canister pressure if pressure in the canister exceeds a threshold.

Alternatively, canister vent valve 311 may be used to draw fresh air into the canister when the canister contents are drawn to the intake manifold.

Fuel vapors originating in fuel tank 315 can be stored in fuel vapor canister 317 when intake manifold pressure is below atmospheric pressure by opening fuel tank vapor valve 313 and fuel vapor management valve 309. In one embodiment, a check valve (not shown) may selectively vent fuel tank 315 to atmosphere. The check valve is held closed when fuel tank pressure is slightly below (e.g., 2 Inches of water below atmospheric pressure) or above atmospheric pressure. The check valve opens when intake manifold pressure draws vapors from the fuel tank to the fuel vapor canister. Thus, vapors from fuel tank 315 are pulled into fuel vapor storage canister 317 and replaced with fresh air from the atmosphere. Alternatively, fuel vapors originating in fuel tank 315 can be stored in fuel vapor canister 317 when fuel tank pressure is above atmospheric pressure by opening fuel tank vapor valve 313 and canister purge valve 311.

Referring now to FIG. 4, a schematic diagram of an example alternative fuel vapor canister purging system is shown. Fresh air enters the intake system air cleaner 400 and passes through compressor 401. Pressurized fresh air may be directed through intercooler 402, pressure purge control valve 407, and/or surge control valve 423. Surge control valve 423 can be used to control compressor outlet pressure. If the compressor outlet pressure exceeds a threshold surge valve 423 can be opened so that a portion of the compressor output is fed back to the compressor input, thereby reducing the compressor efficiency. Pressure purge control valve 407 can be used to control the flow of compressed air to fuel vapor canister 417. Throttle 403 is used to regulate the flow of fresh air into intake manifold 420 and pressure in the intake system downstream from the throttle. Air exits the intake system and enters the engine after passing through intake manifold 420. Fuel vapor management valve 409 can be used to control the flow of fuel vapor from fuel vapor canister 417 to intake manifold 420. Fuel tank vapor valve 413 can be used to control the flow of fuel vapor from fuel tank 415 to fuel vapor canister 417. Fuel tank purge valve 411 can be used to control the flow of fuel vapors from fuel tank 415 to the inlet of compressor 401. A check valve (not shown) may selectively vent fuel tank 415 to atmosphere. The check valve is held closed when fuel tank pressure is slightly below (e.g., 2 Inches of water below atmospheric pressure) or above atmospheric pressure. The check valve opens when vapors are drawn from the fuel tank. Thus, vapors from fuel tank 415 are pulled into the inlet of compressor 401 or into fuel vapor storage canister 417 and replaced with fresh air from the atmosphere.

Note in some embodiments valve 407 or valve 409 may be a mechanical check valve. Further, valve 411 may be a mechanical check valve. In addition, compressor surge control valve 423 may be eliminated and compressor surge controlled by adjusting valves 411, 413, and 407. Specifically, compressor surge can be reduced by opening valves 411, 413, and 407. Thus, the compressor's output can be routed back to the compressor's input by way of canister 417.

In one embodiment, fuel vapor canister 417 can be purged when intake manifold pressure is below barometric pressure by closing pressure purge control valve 407, opening fuel tank purge valve 411, opening fuel tank vapor valve 413, and metering fuel vapor management valve 409. In this way, fresh air can be drawn into fuel vapor canister 417 from upstream of compressor 401.

When intake manifold pressure is above barometric pressure, the fuel vapor canister can be purged by closing fuel tank vapor valve 413, opening pressure purge control valve 407, and metering fuel vapor management valve 409.

The flow rate of vapor from fuel vapor canister 417 is determined by the pressure differential between fuel vapor canister pressure and intake manifold pressure as well as the position of fuel vapor management valve 409. The flow rate from the canister to the engine can be determined as is disclosed in the description of FIG. 3.

Fuel vapors originating in fuel tank 415 can be stored in fuel vapor canister 417 when intake manifold pressure is below atmospheric (barometric) pressure by opening fuel tank vapor valve 413 and fuel vapor management valve 409. The low intake manifold pressure causes fuel vapors to be drawn from the fuel tank to the fuel vapor canister 417. Valves 411 and 407 are closed when fuel vapors are drawn from fuel tank 415 to fuel vapor canister 417.

At higher engine loads, fuel vapors from fuel tank 415 can be purged by opening fuel tank purge valve 411 and closing tank vapor valve 413. The negative pressure developed at the inlet of compressor 401 can be used to draw fuel vapor from fuel tank 415 to compressor 401 and into engine 405. In addition, at high engine loads, the outlet pressure of compressor 401 can be used to pressurize fuel vapor storage canister 417 and drive fuel vapor from the canister through vapor management valve 409 and into intake manifold 420. Thus, the fuel tank and fuel vapor canister may be purged of fuel vapors simultaneously at high engine loads.

The methods, routines, and configurations disclosed herein are exemplary and should not be considered as limiting because numerous variations are possible. For example, the above disclosure may be applied to I3, I4, I5, V6, V8, V10, and V12 engines operating in natural gas, gasoline, diesel, or alternative fuel configurations.

The following claims point out certain combinations regarded as novel and nonobvious. Certain claims may refer to "an" element or "a first" element or equivalent. However, such claims should be understood to include incorporation of one or more elements, neither requiring nor excluding two or more such elements. Other variations or combinations of claims may be claimed through amendment of the present claims or through presentation of new claims in a related application. The subject matter of these claims should be regarded as being included within the subject matter of the present disclosure.

The invention claimed is:

1. A system for purging a vehicle's fuel vapor storage canister, the system comprising:

an internal combustion engine;

a throttle valve for regulating air flow to the internal combustion engine;

a compressor located upstream from the throttle valve in an intake system of said internal combustion engine;

a fuel vapor canister that is in communication with said intake system at a first location that is downstream from the compressor, and the fuel vapor canister also in communication with said intake system at a second location that is downstream from the throttle valve; and a controller that adjusts a position of a valve to produce a desired canister flow rate at a pressure ratio across the valve.

2. The system of claim 1 wherein a first valve is placed in ducting that leads from an outlet of the compressor to the fuel vapor canister and wherein a second valve is placed in ducting that leads from the fuel vapor canister to a location in the intake system downstream from the throttle valve.

3. The system of claim 2 wherein said controller operates the first and second valves such that the fuel vapor canister is purged by flowing air from the outlet of the compressor to the second location downstream from the throttle valve.

4. The system of claim 1 wherein a duct connects a fuel tank to the fuel vapor canister and wherein a valve blocks flow from the fuel vapor canister to the fuel tank.

5. The system of claim 1 wherein said controller adjusts the compressor and a position of the throttle valve to adjust a pressure in the fuel vapor canister.

6. The system of claim 1 wherein a pressure relief valve vents the fuel vapor canister if pressure in the fuel vapor canister exceeds a threshold.

7. The system of claim 1 wherein a duct connects a fuel tank to the intake system at a location upstream of the compressor and bypasses said fuel vapor canister.

8. A method for purging fuel vapors, comprising:

directing a portion of output from a compressor to a fuel vapor canister, the compressor in communication with an intake manifold of an engine; and controlling pressure in the intake manifold by adjusting a position of a throttle valve and a position of a vapor management valve to produce a desired flow rate from the fuel vapor canister to the intake manifold.

9. The method of claim 8 wherein a duty cycle is varied to control a valve that controls a flow rate from the fuel vapor canister to the intake manifold.

10. The method of claim 8 wherein a flow rate from the fuel vapor canister to the intake manifold is controlled by adjusting an outlet pressure of the compressor.

11. The method of claim 10 wherein the outlet pressure of the compressor is controlled by adjusting a position of a waste gate or variable geometry turbine vanes.

12. The method of claim 8 further comprising venting a fuel tank to a location in an intake system of said engine that is upstream from an inlet of the compressor when a pressure in the fuel tank is greater than a threshold.

13. A method for storing and purging fuel vapors in a canister of an engine having a compressor, the method comprising:

drawing fuel vapors from a fuel tank to a canister using intake manifold vacuum during a first condition; and applying a positive air pressure to the canister to push fuel vapors from the canister into an intake manifold during a second condition, said positive air pressure controlled by adjusting at least one of a throttle valve, a surge valve, or a compressor output.

14. The method of claim 13 wherein the first condition is when pressure in the fuel tank is greater than a threshold.

15. The method of claim 13 wherein the second condition is when pressure in the intake manifold is above atmospheric pressure.

16. The method of claim 13 further comprising drawing vapors from the fuel tank to the intake manifold and bypassing the canister when pressure in the fuel tank is greater than a threshold.

17. The method of claim 16 wherein the vapors are drawn into the intake manifold from a location upstream from the compressor.

18. The method of claim 13 wherein the fuel vapors are pushed from the canister to a location in an intake system upstream from the compressor.

19. The method of claim 13 wherein an amount of fuel injected to the engine during the second condition is reduced in proportion to an amount of actual or estimated fuel vapor pushed from the canister to an intake system.

20. The method of claim 19 wherein the amount of fuel injected to the engine is adjusted by feedback from an oxygen sensor.

21. The method of claim 13 wherein the first condition is a pressure of the intake manifold of said engine less than barometric pressure.

* * * * *